US007223035B1

(12) United States Patent
Engel

(10) Patent No.: US 7,223,035 B1
(45) Date of Patent: May 29, 2007

(54) DEVICE FOR CONTAINING AND APPLYING COSMETICS

(75) Inventor: Steven P. Engel, Rockford, MI (US)

(73) Assignee: Access Business Group International LLC, Ada, MI (US)

( * ) Notice: Subject to any disclaimer, the term of this patent is extended or adjusted under 35 U.S.C. 154(b) by 0 days.

(21) Appl. No.: 11/305,398

(22) Filed: Dec. 16, 2005

(51) Int. Cl.
*A46B 11/00* (2006.01)

(52) U.S. Cl. ..... 401/126; 401/129; 401/122

(58) Field of Classification Search ..... 401/121, 401/122, 126, 128–130, 183, 184, 185
See application file for complete search history.

(56) References Cited

U.S. PATENT DOCUMENTS 2,869,162 A * 1/1959 Dritz ..... 401/26
3,951,157 A 4/1976 Idec
4,628,950 A * 12/1986 Bitzer ..... 132/218
4,780,017 A 10/1988 Bradford
4,810,122 A 3/1989 Cole
4,889,228 A 12/1989 Gueret
4,982,838 A 1/1991 Fitjer
5,636,931 A 6/1997 Gueret
5,687,862 A * 11/1997 Barbier et al. ..... 215/40
5,743,279 A 4/1998 Gueret
5,803,638 A * 9/1998 Gueret ..... 401/122
5,862,818 A 1/1999 Marinelli
6,039,487 A * 3/2000 Kristiansen ..... 401/126
6,082,918 A 7/2000 Gueret
6,158,912 A 12/2000 Miraglia et al.
6,257,788 B1 * 7/2001 Gueret ..... 401/129
6,287,034 B1 9/2001 Miraglia et al.
6,447,191 B1 * 9/2002 Vasas ..... 401/7
6,474,890 B1 11/2002 Gueret
6,523,548 B2 2/2003 Bouix et al.
6,572,296 B2 6/2003 Schrepf
6,676,320 B1 1/2004 Wainer
6,866,046 B2 3/2005 Gueret
2002/0195117 A1 12/2002 Bailly
2004/0035437 A1 2/2004 Gueret
2004/0244808 A1 12/2004 Mathiez
2004/0247372 A1 12/2004 Petit

* cited by examiner

*Primary Examiner*—David J. Walczak
(74) *Attorney, Agent, or Firm*—Warner Norcross & Judd LLP

(57) ABSTRACT

A device for containing and applying cosmetics includes a container that has a flexible product containing portion and a neck portion extending therefrom. An applicator attaches to the neck of the container and includes a wand and head that extend into the container such that the wand extends through the neck and the head extends into the product containing portion. The container may include an integral wiper that extends inwardly from the base of the neck. The head passes through the wiper when it is removed from the product containing portion, such that excess mascara is wiped off the head during removal. The flexible portion can be squeezed to load the brush with mascara and can be pinched to remove any tail of cosmetics that might otherwise form on the head.

10 Claims, 2 Drawing Sheets

DEVICE FOR CONTAINING AND APPLYING COSMETICS

BACKGROUND OF THE INVENTION

The present invention relates generally to cosmetic containers, and more particularly to a device for containing and applying brush-applied cosmetics.

A number of devices are well known for use in containing and applying brush-applied cosmetics, such as mascara. A typical one of these devices includes a rigid bottle containing a selected mascara product, and a removable applicator. The applicator attaches to the bottle to form a cover for the bottle, and includes an elongated wand that extends into the bottle when the applicator is attached. The wand has a brush on the end that becomes loaded with mascara when the wand is inserted into the bottle. When the cover and wand are removed from the bottle, the mascara on the brush can be applied directly to a user's eyelashes.

Unfortunately, conventional devices for packaging and applying mascara are subject to a number of drawbacks. First, the long, straight wand can make it difficult to access all of the mascara in the bottle, forcing consumers to waste some of the mascara in every container. Second, when the brush is removed from the bottle, a tail of excess mascara often remains on the tip of the brush, which can lead to improper application of mascara to unwanted parts of a user's eye area. Third, because the wand travels through the mascara during insertion and removal from the bottle, some mascara remains on the wand during application, which can be unsightly in appearance and potentially messy for users.

SUMMARY OF THE INVENTION

The aforementioned problems are overcome by the present invention, wherein a device for packaging and applying applicator-applied cosmetics includes a container having a flexible product containing portion and a neck portion.

In one embodiment, the device includes a container and an applicator. The container includes a flexible product containing portion, and an elongated neck extending therefrom. The applicator attaches to the neck of the container and includes a wand and brush that extend into the container such that the wands extends through the elongated neck and only the brush extends into the product containing portion.

In another embodiment, the container includes an integral wiper. The wiper is positioned near the base of the neck, and extends inwardly toward the wand when the wand is inserted into the container. The brush passes through the wiper when it is inserted or removed from the product containing portion, such that excess mascara is wiped off the brush during removal.

The mascara container of the present invention provides a number of advantages. First, the elongated neck keeps the wand clean for improved appearance and application. Second, the flexible product containing portion allows a user to access all of the mascara within the container, by squeezing the container to deposit mascara on the brush. The flexible portion also allows a user to pinch the brush as it is pulled from the container to remove the tail of mascara on the tip of the brush. Third, the integral wiper wipes excess mascara from the brush as the brush is pulled from the product containing portion.

These and other objects, advantages, and features of the invention will be readily understood and appreciated by reference to the detailed description of the current embodiments and the drawings.

DETAILED DESCRIPTION OF THE INVENTION

I. Overview

Figure 1:
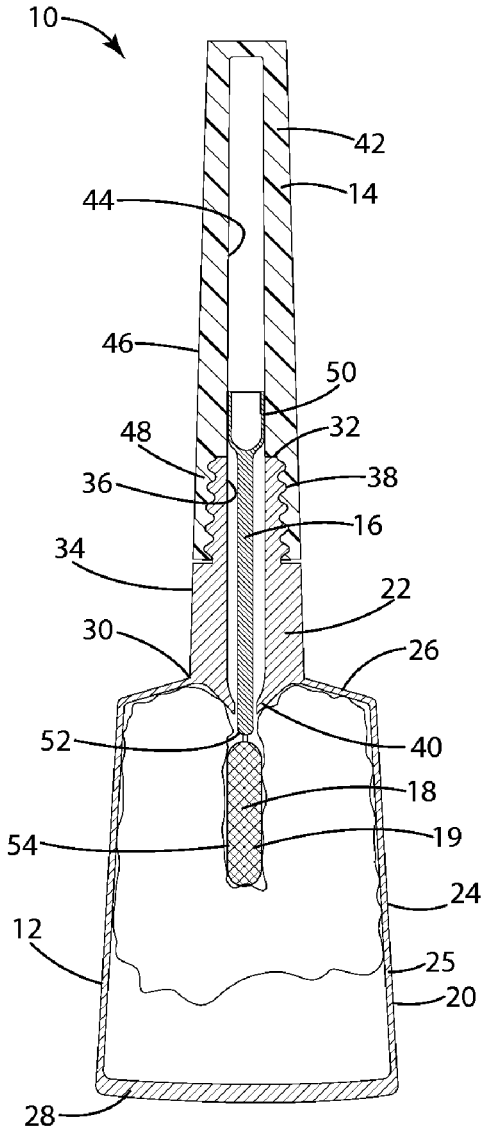
FIG. 1 is a cross sectional view of the device according to one embodiment of the present invention.

A device for containing and applying cosmetics, such as mascara in accordance with one embodiment, is shown in FIG. 1, and generally designated 10. The device 10 generally includes a container 12 and an applicator 14. The container 12 includes a flexible product containing portion 20 and a neck 22. The applicator 14 attaches to the container 12, and includes a wand 16 and an applicator head 18. When the applicator 14 is attached to the container 12, the wand 16 extends through the neck 22 and the head 18 extends into the product containing portion 20.

II. Structure

Figure 2:
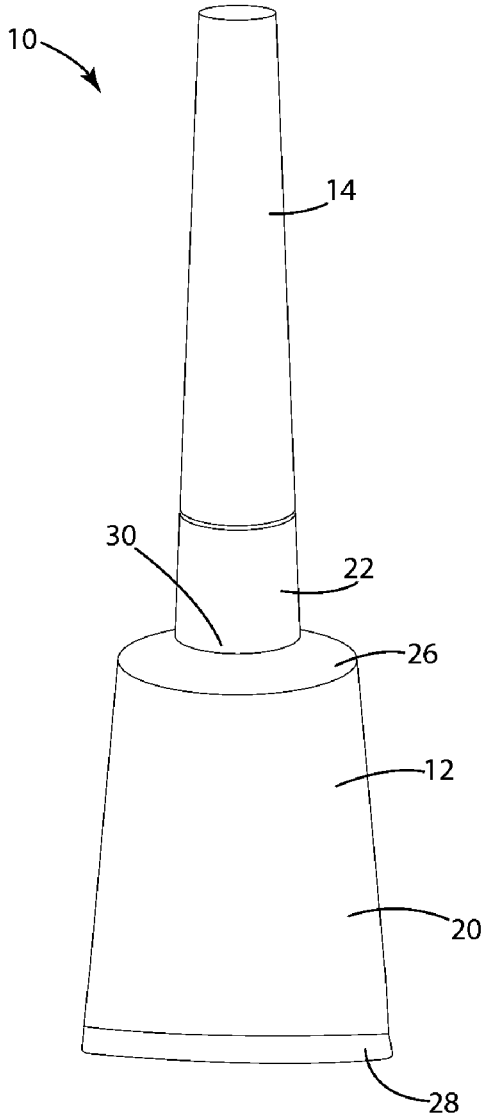
FIG. 2 is a front view of the device thereof.
Figure 3:
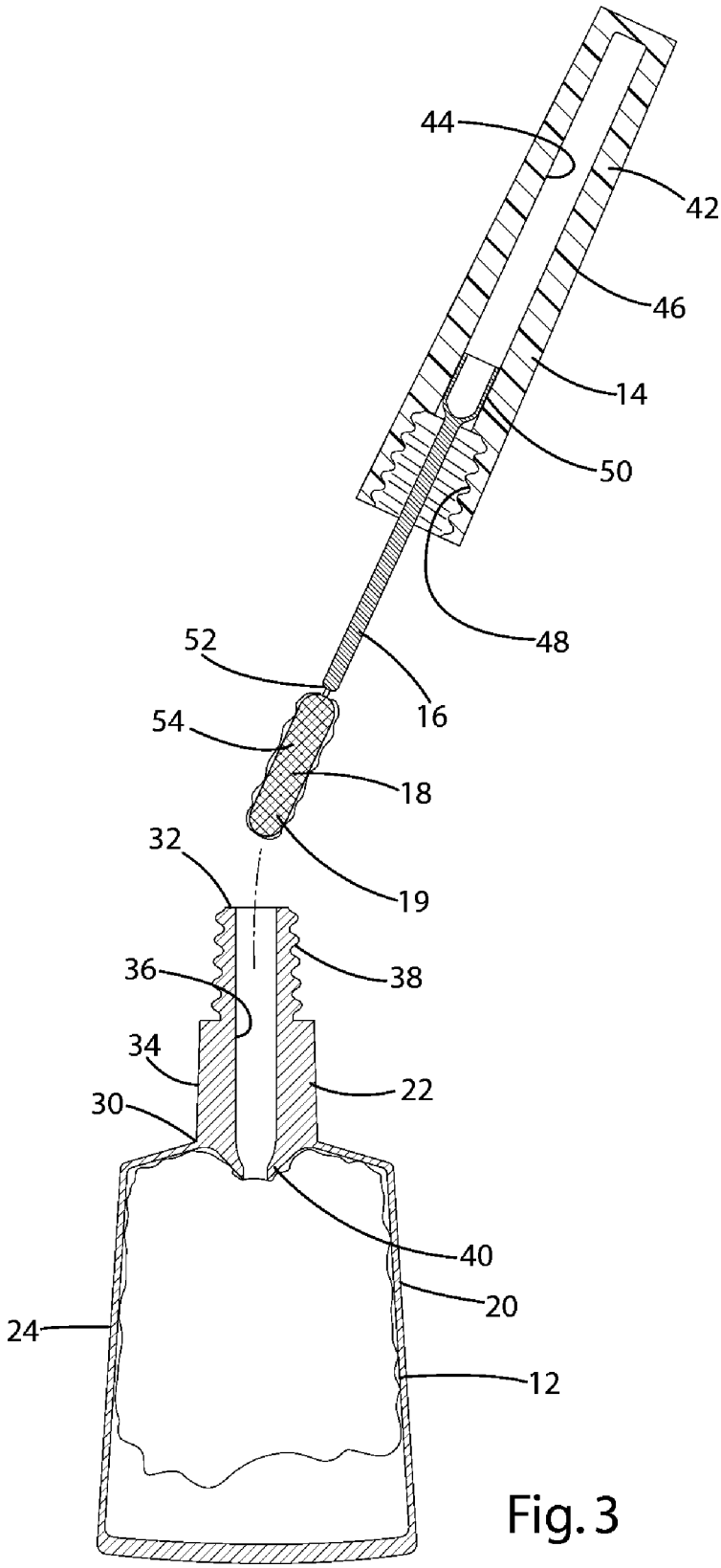
FIG. 3 is an exploded view of the applicator removed from the container.

In the illustrated embodiment, the container 12 generally includes a flexible product containing portion 20 and a neck 22 and generally contains a cosmetic product 25, such as mascara. As shown in FIG. 2, the product containing portion 20 may be constructed similar to a toothpaste container, such that it includes a flexible sidewall 24. The flexible sidewall may be a resilient plastic, or another flexible material. The sidewall 24 has a first end 26 that is generally cylindrical, and tapers to a second end 28 that is generally flat. Alternatively, the flexible product containing portion may have a variety of shapes, for instance, it may be entirely cylindrical. The neck 22 extends from the product containing portion 20 from a first end 30 that forms a base to a second end 32 that forms the rim of the container 12. The neck 22 generally extends from the product containing portion 20 a distance approximately equal to the length of the wand 16, described in more detail below. The neck 22 may be rigid, such that it cannot be flexed in a manner similar to the product containing portion 20. In one embodiment, this rigidity is accomplished by forming the neck 22 from a thicker material than the product containing portion 20. As shown in FIG. 1, the neck 22 includes an outer surface 34 and an inner surface 36. The neck 22 includes structure for attaching the applicator 14 to the container 12. In the illustrated embodiment, the attachment structure is disposed on the outer surface 34, but it may alternatively be disposed on the inner surface 36. In the illustrated embodiment, this structure is threads 38, however, a variety of attachment methods are available, such as snap fit or friction fit.

In one embodiment, shown in FIG. 1, the neck 22 may include a wiper 40. The wiper 40 extends inwardly from the inner surface 36 of the neck 22 to define an opening smaller than the head 18. As shown, the wiper 40 extends around the entire circumference of the inner surface 36 of the neck 22, however, it may alternatively be limited to a portion of the circumference. The wiper 40 may be flexible or substantially rigid, and may be formed from a variety of materials, such as plastic or metal. As shown, the wiper is substantially rigid. The wiper 40 may be formed integrally with the neck 22 and the container 12, such that it extends from the base 30 of the neck 22 to substantially separate the product containing portion 20 from the neck 22. As shown, the wiper 40 angles into the product containing portion 20. As described below, the wiper 40 extends inwardly to a length that allows the wiper 40 to engage the head 18 as the head 18 is removed from the product containing portion.

The applicator 14 attaches to the container 12 and forms a cover for the container 12. As shown in FIG. 1, the applicator includes a cap 42, a wand 16 and a head 18. As illustrated, the cap 42 is cylindrical, although it may be any shape. The cap 42 includes an inner surface 44 and an outer surface 46. The cap 42 includes structure for attaching the applicator 14 to the container. The structure may vary from applicator to applicator, for instance, the attachment structure of the illustrated embodiment is threads 48 on the inner surface 44. The wand 16 may be a variety of elongated structures, and includes a first end 50 attached to the inner surface 44 of the sidewall of the cap 42 and a second end 52 extending outwardly from the sidewall of the cap 42. The length of the wand 16 is approximately the same as the length of the neck 22 of the container 12, but its length may vary. In this embodiment, the head 18 is a brush 19. The brush 19 extends from the second end 52 of the wand 16 and includes bristles 54 or other structure for applying a cosmetic product to a user's eyelashes. As shown in FIG. 1, when the applicator 14 is attached to the container 12, the wand 16 extends through the neck 22 and approximately only the head 18 extends through the wiper 40 and into the product containing portion 20.

III. Operation

The device 10 is generally distributed to consumers with the applicator 14 attached to the container 12, as shown in FIG. 1. When a consumer desires to access the cosmetic 25, the applicator 14 is unscrewed from the neck 22 of the container 12 and the consumer pulls the applicator 14 from the container 12. As the applicator 14 is pulled from the container 12, the consumer may grip the flexible product containing portion 20 and flex the sidewall 24 to engage the sidewall 24 with the head 18 and pinch the head 18 to prevent excess cosmetic 25 from collecting on the tip of the head 18. The head 18 then passes through the wiper to additionally prevent the collection of excess cosmetic 25 on the head 18. The wand 16 and head 18 are then removed from the container 12 completely, and the head 18 is used to apply cosmetic as desired. After this application, the head 18 and wand 16 are re-inserted into the container 12. As the supply of cosmetic 25 in the product containing portion 20 is depleted, the flexible sidewall 24 can continually be flexed and pinched to move the remaining cosmetic 25 onto the head 18, until all of the cosmetic 25 has been removed from the container 12 and applied.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A device for containing and applying mascara comprising:

a container including a flexible product containing portion and a neck extending outwardly from said product containing portion, said neck including a base adjacent said product containing portion, said neck including a flexible wiper extending inwardly from said base; and an applicator, said applicator including a wand extending therefrom, said wand having a distal end including a head, said applicator being attachable to said neck to cover said container, said applicator attached to said neck with said wand extending through said neck and approximately only said head extending into said product containing portion, wherein said neck is rigid and includes external threads adapted to attach to said applicator.

2. The device of claim 1 wherein said applicator includes a generally cylindrical wall having an inner surface and an outer surface, said wand attached to said inner surface, said inner surface including threads that are adapted to engage said external threads on said neck.

3. The device of claim 1 wherein said wiper is adapted to engage said head when said head is removed from said product containing portion.

4. A device for containing and applying mascara comprising:

an applicator including a wand and a head, said wand having a length and an end, said head extending from said end; and a container including a product containing portion and an elongated, rigid neck, said neck extending outwardly from the product containing portion approximately said length of said wand such that approximately only said head extends into said product containing portion, said product containing portion including a flexible wall that can be flexed to engage said head when said head is extended into said product containing portion.

5. The device of claim 4 wherein said container includes an integral wiper, said wiper extending toward said wand when said applicator is received by said container such that said wiper engages said head when said head is removed from said product containing portion.

6. The device of claim 5 wherein said neck includes a base adjacent said product containing portion, said wiper extending from said base.

7. The device of claim 4 wherein said elongated, rigid neck is generally cylindrical and includes an outer surface having threads for attaching to said applicator.

8. The device of claim 7 wherein said applicator includes a generally cylindrical sidewall having an inner surface and an outer surface, said wand attached to said inner surface, sand inner surface including threads for attaching to said threads on said neck.

9. The device of claim 4 wherein said product containing portion includes a first end and a second end, said first end being generally cylindrical, said second end being generally flat.

10. A device for storing and applying mascara comprising:

an applicator including a sidewall, a wand, and a brush, said wand having a first end, a second end and a length, said first end attached to said sidewall, said brush extending from said second end; and a container, said container including a product containing portion and a neck extending therefrom, said product containing portion having a first end, a second end and a flexible sidewall extending therebetween, said neck being substantially rigid and including a base adjacent said product containing portion, a length approximately the same as said length of said wand, and a means for attaching said applicator to said neck, said neck including an inner surface and an outer surface, and an integral wiper extending inwardly from said inner surface at said base of said neck, said second end of said wand being adjacent to said wiper when said applicator is attached to said neck.

* * * * *